US007406916B2

(12) United States Patent
Panteleos et al.

(10) Patent No.: US 7,406,916 B2
(45) Date of Patent: Aug. 5, 2008

(54) CONSERVATION OF ENERGY TRANSFER DURING AN EMERGENCY STOP

(75) Inventors: John Antonios Panteleos, York, ME (US); Glen Courtland Jerry, Dover, NH (US); Kevin Lauren Cote, Durham, NH (US); Lothar John Schroeder, Portsmouth, NH (US)

(73) Assignee: Goss International Americas, Inc., Dover, NH (US)

( * ) Notice: Subject to any disclaimer, the term of this patent is extended or adjusted under 35 U.S.C. 154(b) by 391 days.

(21) Appl. No.: 11/265,622

(22) Filed: Nov. 2, 2005

(65) Prior Publication Data

US 2007/0095228 A1 May 3, 2007

(51) Int. Cl.
*B41F 13/004* (2006.01)
*B41F 13/016* (2006.01)
*B41F 13/24* (2006.01)

(52) U.S. Cl. ..... 101/247; 101/216; 101/484

(58) Field of Classification Search ..... 101/216, 101/247, 484; *B41F 13/004, 13/016*
See application file for complete search history.

(56) References Cited

U.S. PATENT DOCUMENTS 3,280,737 A 10/1966 Huck
3,473,468 A * 10/1969 Seel et al. ..... 101/137
3,477,367 A * 11/1969 Richards ..... 101/137
4,130,057 A 12/1978 List et al.
5,445,076 A 8/1995 Sugiyama et al.
5,524,541 A * 6/1996 Schwinn et al. ..... 101/484
5,649,482 A 7/1997 Hummel et al.
6,078,156 A 6/2000 Spurr
6,213,016 B1 * 4/2001 Tsunashima ..... 101/218
6,823,792 B2 11/2004 Grutzmacher et al.

* cited by examiner

*Primary Examiner*—Leslie J Evanisko
(74) *Attorney, Agent, or Firm*—Davidson, Davidson & Kappel, LLC

(57) ABSTRACT

According to an exemplary embodiment of the present invention, a method for operating a multi-unit printing arrangement, including multiple individual motors is provided. The method comprises the steps of operating the multi-unit printing arrangement, stopping the multi-unit printing operation by braking the multiple motors in stop operations, and staggering impression throw operations for individual units by a preselected time delay between commencement of each impression throw operation, a duration of the time delay between commencement of sequential impression throw off operations being selected to be of sufficient duration such that there is no overlap of large torque disturbances experienced at the multiple motors.

7 Claims, 5 Drawing Sheets

CONSERVATION OF ENERGY TRANSFER DURING AN EMERGENCY STOP

BACKGROUND OF THE INVENTION

In many printing operations, a printer comprises multiple print units, arranged in a sequence, in a processing line. Each of the print units comprises rollers arranged and configured to impress an image on a substrate such as newsprint, as it passes between the rollers, in a well known printing technique. The rollers comprise, for example, in a offset printer, a blanket cylinder and an opposed printing plate cylinder. The print units may each apply a different color ink, for example, the three primary colors and black.

Typically, a motor is coupled to each of the cylinders of each print unit. Conventional electrical braking methods are often implemented for stopping each motor quickly, when necessary, as for example, during an emergency stop of multiple print units. The braking methods include dynamic braking. In a dynamic braking method, the flow of current in the motor armature is reversed while, at the same time, maintaining the motor field. This action effectively converts the rotating energy of the motor armature into current flow, so that the motor acts as a generator, producing a back-EMF current flow in reverse direction from the flow of drive current, a regenerative power.

A high-wattage braking resistor is then switched across the armature to dissipate this regenerated current, bringing the motor to a stop. The effective stopping speed is a function of resistance; the lower the resistor value (therefore, the greater the reversed current flowing through the armature), the faster the motor can be stopped. In many multi-print unit arrangements, all of the motors of the various print units utilize a common bus for drive current, and share a single braking resistor arrangement. The braking resistor arrangement can comprise a single resistor, or multiple resistors, such as a common arrangement of several resistors coupled in parallel to one another.

In a print unit braking operation there is an impression cylinder throw off. There can be a transient torque peak during the impression cylinder throw off. The peak condition results in a requirement for a certain size of braking resistor arrangement to handle the increased current flow caused by the surging regenerative power, during the transient event.

In an emergency stop condition, when the entire multi unit operation must be stopped, all of the motors are stopped, and all of the impression cylinders are thrown off, essentially simultaneously. This results in a cumulative transient torque peak event. Thus, the braking resistor arrangement must be of sufficient size to handle the transient event characteristics of several motors, at the same time. This requirement for a relatively large braking resistor arrangement and other corresponding braking components, adds considerable cost to the overall cost of the print unit arrangement, and also adds to the physical space requirements for the installation of the units.

SUMMARY OF THE INVENTION

The present invention provides a method to conserve the amount of energy transfer during an emergency stop, and thereby reduce the size requirement for a braking resistor arrangement and other corresponding braking components. The present invention is particularly advantageous in printing operations utilizing a common braking resistor arrangement in an electrical braking method.

According to an exemplary embodiment of the present invention, a method for operating a multi-unit printing arrangement, including multiple individual motors is provided. The method comprises the steps of operating the multi-unit printing arrangement, stopping the multi-unit printing operation by braking the multiple motors in stop operations, and staggering impression off stop operations for individual print units by a preselected time delay between commencement of each impression off operation, a duration of the time delay between commencement of sequential impression off operations being selected to be of sufficient duration such that there is no overlap of large torque disturbances experienced at the multiple motors.

In a further exemplary embodiment, the present invention provides a printing arrangement comprising multi units for performing a multi-unit printing operation, multiple, individual motors for driving the multi units, and a controller for controlling operation of the multiple, individual motors. According to a feature of the present invention, the controller is arranged and configured to stop the multi-unit printing operation by braking the multiple motors in stop operations, and further operates to stagger impression throw off operations, for individual units, by a preselected time delay between commencement of each impression throw off operation. A duration of the time delay between commencement of sequential impression throw off operations is selected to be of sufficient duration such that there is no overlap of large torque disturbances experienced at the multiple motors.

DETAILED DESCRIPTION OF THE PREFERRED EMBODIMENTS

Figure 1:
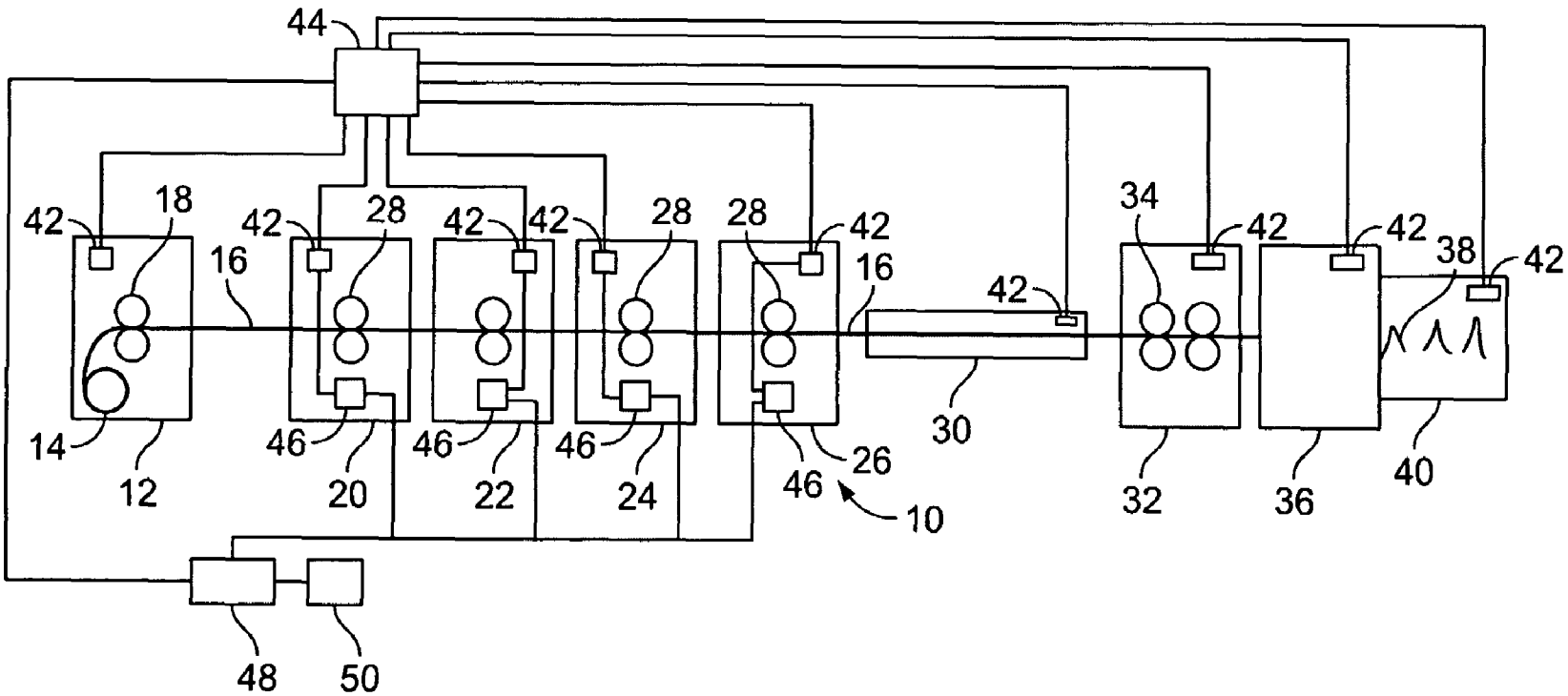
FIG. 1 is a schematic block diagram of a multi-print unit arrangement.

Referring now to the drawings, and initially to FIG. 1 there is shown a schematic block diagram of a known multi-print unit arrangement. The printing press arrangement 10 includes a splicer 12 that mounts a roll 14 of product such as, for example, a roll of newsprint 16. The newsprint 16 is feed from the mounted roll 14 by a pair of drive rollers 18 to a sequence of printers 20, 22, 24, 26.

Each of the printers 20, 22, 24, 26 comprises rollers 28 arranged and configured to impress an image on the newsprint 16 as it passes between the rollers, in well known printing techniques. The printers 20, 22, 24 26 may each apply a different color ink, for example, the three primary colors and black.

A dryer 30 is arranged downstream from the printers 20, 22, 24, 26. The dryer 30 is used to apply heat to the passing newsprint 16 to dry the ink of the images impressed by the printers 20, 22, 24, 26. The newsprint 16 then passes to a cooling unit 32, for passage between water cooled rollers 34 before entry into a folder 36. The folder 36 cuts and folds the roll of newsprint 16 into individual signatures 38 for input to a delivery mechanism 40, as well known in the art.

A plurality of control units 42 is arranged in the printing press arrangement, one in each component, to control operation of the corresponding component. A central controller 44, which may comprises a computer, is coupled to each of the control units 42 for a centralized, automated control of overall printing press operation, as is well known in the art. By way of example, each control unit 42 is also coupled to a drive motor 46 for rotating a corresponding one of the rollers 28.

A common power supply 48 is provided for driving each the of motors 46. As described above, when the central controller 44 operates to stop a motor 46, via stop commands to the corresponding control unit 42, in a conventional electrical braking method, flow of current in the motor armature of the motor 46 to be stopped, is reversed while, at the same time, the motor field is maintained. This action effectively converts the rotating energy of the motor 46 into current flow, so that the motor acts as a generator, producing a back-EMF current flow in reverse direction from the flow of drive current, a regenerative power. A common, high-wattage braking resistor arrangement 50 is provided for controlled switching across the common power supply 48 for the motor 46 to be stopped, to dissipate this regenerated current, bringing the motor 46 to a stop. In the multi-print unit arrangement shown in FIG. 1, all of the motors 46 utilize the common braking resistor arrangement 50 during a stop operation.

Figure 2:
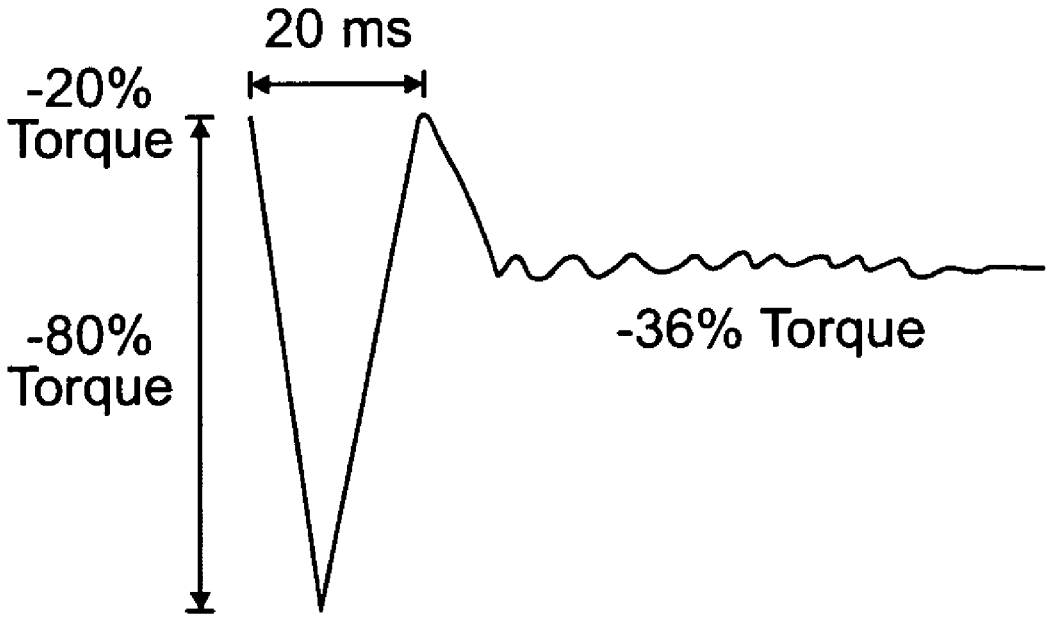
FIG. 2 is a graphic representation of a single unit motor torque curve during an emergency stop.

Referring now to FIG. 2, there is shown a graphic representation of a single unit motor torque curve during an emergency stop. During an emergency stop, the motor's torque gradually increases to a −20% torque. When the impression cylinder of the corresponding printer 20, 22, 24, 26 is thrown off, as is conventional, a torque disturbance is introduced for a period of approximately 20 milliseconds, resulting in an amplitude of −80% of the full torque value of the motor 46. Thereafter, during a linear portion of the braking operation, the torque decreases to −36% torque until the motor 46 has come to a complete stop. The −80% torque peak is feed back and absorbed across the common braking resistor arrangement 50. This requires a braking resistor arrangement 50 large enough to absorb the torque surge event without causing an over voltage condition.

Figure 3A:
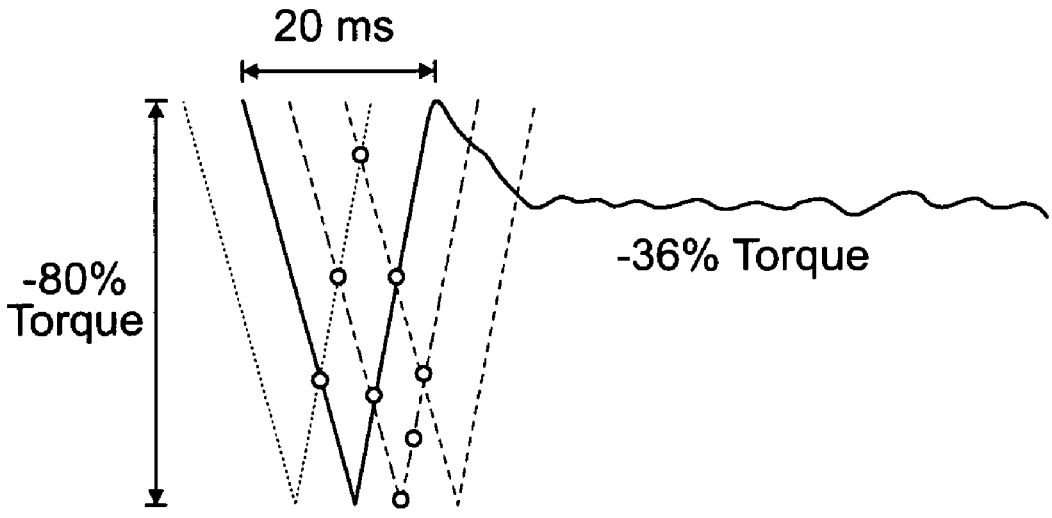
FIG. 3*a* is a graphic representation of torque curves for multiple unit motors stopping together during a typical emergency stop.

FIG. 3*a* shows a graphic representation of motor torque curves during an emergency stop with four printers 20, 22, 24, 26 stopping together. The intersections between the individual curves are marked to show the overlap of the torque disturbances among the motors 46 of the printers 20, 22, 24, 26. The −80% torque surge overlaps are additive in respect to the total braking energy being dissipated across the braking resistor arrangement 50, at any one time. The spread of torque peak events between motors 46, is, in known printing operations, typically at most 16 milliseconds.

Figure 3B:
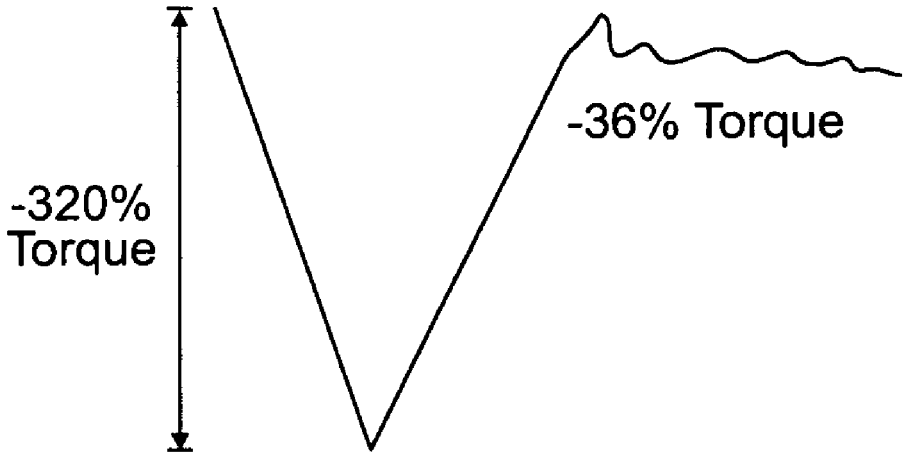
FIG. 3*b* is a graphic representation of torque curves for multiple unit motors stopping together during an emergency stop when all motor stop events occur in the same instance in time.
Figure 4:
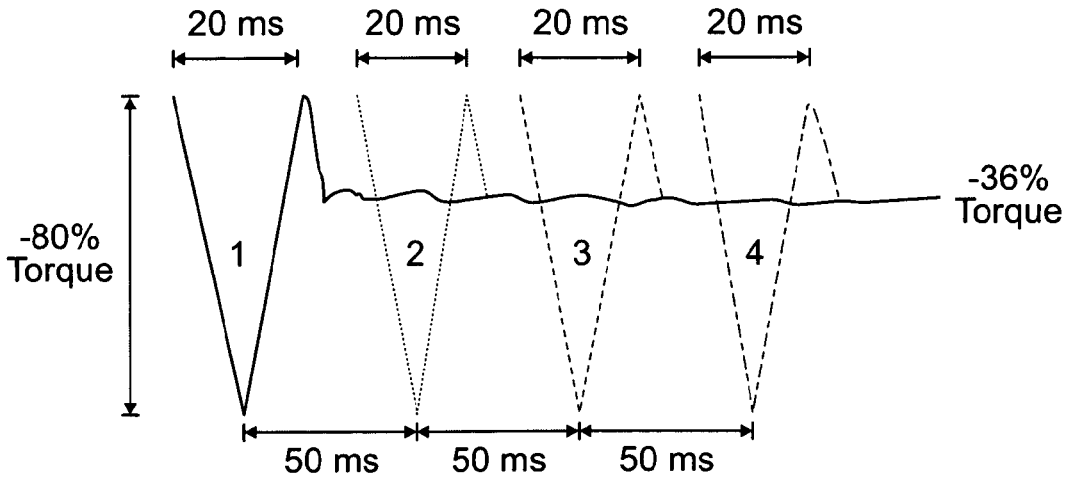
FIG. 4 is a graphic representation of torque curves for multiple unit motors stopping together during an emergency stop according to a feature of the present invention.

Often, the peak −80% torque of multiple motors 46 occur in the same instance of time, thereby causing the braking energy being dissipated across the common braking resistor arrangement 50 to double, triple or even quadruple, in value. For example, FIG. 3*b* illustrates four events occurring in the same instance of time causing, additively, a −320% torque spike. Thus, the common braking resistor arrangement 50 must be large enough to handle such a large torque spike during an emergency stop. This adds to the cost and size of the overall printing system.

In accordance with a feature of the present invention, the central controller 44 operates to perform an emergency stop for the multi-unit printing press arrangement 10 wherein, in connection with the stop operations for the individual motors 46, the impression throw off operations for the multi-unit arrangement are started in a sequence, staggered by a preselected time delay between commencement of each impression throw off operation. The duration of the staggering time between commencement of sequential operations is selected to be of sufficient duration such that there is no overlap of large torque disturbances. Thus, there will only be one motor 46 at any instance of time that is experiencing a torque disturbance. Accordingly, the braking energy that needs to be dissipated over the common braking resistor arrangement 50 at any one time is minimized, and the braking resistor arrangement can be implemented as a fraction of what was required in known common bus arrangements, for example, 50% smaller. This results in considerable savings in cost and space.

In a preferred embodiment of the present invention, the staggering time is 50 milliseconds.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A method for operating a multi-unit printing arrangement, including multiple individual motors, comprising the steps of:

operating the multi-unit printing arrangement;

stopping the multi-unit printing operation by braking the multiple motors in stop operations; and staggering impression throw off operations for individual units by a preselected time delay between commencement of each throw off operation, a duration of the time delay between commencement of sequential throw off operations being selected to be of sufficient duration such that there is no overlap of large torque disturbances experienced at the multiple motors.

2. The method of claim 1 wherein the time delay is 50 milliseconds.

3. The method of claim 1 wherein each stop operation comprises an electrical braking method.

4. The method for claim 3 comprising the further step of providing a common braking resistor arrangement for use among the individual motors in the electrical braking method.

5. A printing arrangement comprising:

multi units for performing a multi-unit printing operation;

multiple, individual motors for driving the multi units; and a controller for controlling operation of the multiple, individual motors;

the controller being arranged and configured to stop the multi-unit printing operation by braking the multiple motors in stop operations, and further controlling impression throw off operations to be staggered, for individual units, by a preselected time delay between commencement of each impression throw off operation, a duration of the time delay between commencement of sequential impression throw off operations being selected to be of sufficient duration such that there is no overlap of large torque disturbances experienced at the multiple motors.

6. The printing arrangement of claim 5 wherein each stop operation comprises an electrical braking method.

7. The printing arrangement of claim 6 further comprising a common braking resistor arrangement for use among the individual motors in the electrical braking method.

* * * * *